US008188962B2

(12) United States Patent
Guo et al.

(10) Patent No.: US 8,188,962 B2
(45) Date of Patent: May 29, 2012

(54) LIQUID CRYSTAL DISPLAY HAVING LOGIC CONVERTER FOR CONTROLLING PIXEL UNITS TO DISCHARGE

(75) Inventors: Wei Guo, Shenzhen (CN); Yaw-Shing Tseng, Miao-Li (TW)

(73) Assignees: Innocom Technology (Shenzhen) Co., Ltd., Guangdong Province (CN); Innolux Display Corp., Miaoli County (TW)

( * ) Notice: Subject to any disclaimer, the term of this patent is extended or adjusted under 35 U.S.C. 154(b) by 994 days.

(21) Appl. No.: 12/157,016

(22) Filed: Jun. 6, 2008

(65) Prior Publication Data

US 2008/0303775 A1 Dec. 11, 2008

(30) Foreign Application Priority Data

Jun. 8, 2007 (CN) ..... 2007 1 0074777

(51) Int. Cl.
*G09G 3/32* (2006.01)
*G09G 3/18* (2006.01)

(52) U.S. Cl. ..... 345/98; 345/87; 345/52

(58) Field of Classification Search ..... 345/87–104; 326/30, 104, 130, 133
See application file for complete search history.

(56) References Cited

U.S. PATENT DOCUMENTS

| | | | | |
|---|---|---|---|---|
| 7,109,965 | B1 | 9/2006 | Lee et al. | |
| 7,271,801 | B2 * | 9/2007 | Toyozawa et al. | 345/211 |
| 2002/0145577 | A1 * | 10/2002 | Lin et al. | 345/87 |
| 2004/0104908 | A1 * | 6/2004 | Toyozawa et al. | 345/211 |
| 2006/0208994 | A1 * | 9/2006 | Kuo et al. | 345/98 |
| 2006/0284820 | A1 * | 12/2006 | Hong et al. | 345/100 |

OTHER PUBLICATIONS

Robert W. Newcomb, (editor), Teuvo Kohonen, Digital Circuits and Devices, 1972, Prentice-Hall, Inc. p. 40.*
Ronald J. Tocci and Neal S. Widmer, Digital systems: Principals and applicatrions, 7th edition, pp. 70 and 77.*
Deepak Kumar Tala, Digital Logic Gates Part-1, May 30, 2007, Http://www.asic-world.com/digital/gates1.html.*

* cited by examiner

*Primary Examiner* — Amare Mengistu
*Assistant Examiner* — Mihir Rayan
(74) *Attorney, Agent, or Firm* — Muncy, Geissler, Olds & Lowe, PLLC

(57) ABSTRACT

An exemplary liquid crystal display (200) includes a liquid crystal panel (240) having pixel units (248), a scanning circuit (210) configured to activate the pixel units, and a power supply circuit (230) having a control unit (231) and a logic converter (232). The control unit generates a control signal when an external command is applied to the power supply circuit. The logic converter carries out a predetermined logic calculation between the control signal and the external command. The scanning circuit activates all the pixel units to discharge in response to a result of the logic calculation, such that an image displayed by the liquid crystal panel is removed.

10 Claims, 3 Drawing Sheets

LIQUID CRYSTAL DISPLAY HAVING LOGIC CONVERTER FOR CONTROLLING PIXEL UNITS TO DISCHARGE

FIELD OF THE INVENTION

The present invention relates to liquid crystal displays (LCDs), and more particularly to an LCD that has a logic converter configured for controlling pixel units to discharge when the LCD is switched off.

GENERAL BACKGROUND

LCDs are widely used in various electronic information products, such as notebooks, personal digital assistants, video cameras, and the like.

FIG. 4 is an abbreviated circuit diagram of a conventional LCD. The LCD 10 includes a scanning circuit 110, a data circuit 120, a power supply circuit 130, and a liquid crystal panel 140. The liquid crystal panel 140 includes n rows of parallel scanning lines 141 (where n is a natural number), m columns of parallel data lines 142 perpendicular to the scanning lines 141 (where m is also a natural number), and a plurality of pixel units 148 cooperatively defined by the crossing scanning lines 141 and data lines 142. The pixel units 148 are arranged in a matrix. The scanning lines 141 are connected to the scanning circuit 110, and the data lines 142 are connected to the data circuit 120.

Each pixel unit 148 includes a thin film transistor (TFT) 143, a pixel electrode 144, and a common electrode 145. A gate electrode of the TFT 143 is connected to a corresponding one of the scanning lines 141, and a source electrode of the TFT 143 is connected to a corresponding one of the data lines 142. Further, a drain electrode of the TFT 143 is connected to the pixel electrode 144. The common electrode 145 is generally opposite to the pixel electrode 144, with liquid crystal molecules (not shown) sandwiched therebetween, so as to cooperatively form a liquid crystal capacitor 147.

Referring to FIG. 5, the power supply circuit 130 includes a control unit 131, a first transistor 132, a second transistor 133, a resistor 134, and an output terminal 135. The first and second transistors 132, 133 are both P-channel metal oxide semiconductor (PMOS) transistors. A gate electrode of the first transistor 132 is connected to the control unit 131, and a drain electrode of the first transistor 132 is configured to receive a power voltage signal VCC. Further, a source electrode of the first transistor 132 is connected to the output terminal 135, and also connected to a drain electrode of the second transistor 133. A gate electrode of the second transistor 133 is connected to the control unit 131, and a source electrode of the second transistor 133 is grounded via the resistor 134. The output terminal 135 is further connected to the scanning circuit 110.

In operation, the scanning circuit 110 provides a plurality of scanning signals to the scanning lines 141 sequentially, so as to activate the pixel units 148 row by row. The data circuit 120 provides a plurality of data voltage signals to the pixel electrodes 144 of the activated pixel units 148. Thereby, the liquid crystal capacitors 147 of the activated pixel units 148 are charged, and an electric field is generated between the pixel electrode 144 and the common electrode 145 in each pixel unit 148. The electric field drives the liquid crystal molecules to control light transmission of the pixel unit 148, such that the pixel unit 148 displays a particular color (red, green, or blue) having a corresponding gray level. The aggregation of colors displayed by all the pixel units 148 simultaneously constitutes an image viewed by a user of the LCD 10.

When the LCD 10 is switched off, an external command is provided to the control unit 131 of the power supply circuit 130, and the control unit 131 correspondingly provides a low level voltage signal to switch the first transistor 132 on, and provides a high level voltage signal to switch the second transistor 133 off. Thereby, the power voltage signal VCC is outputted to the scanning circuit 110 via the first transistor 132. Due to the power voltage signal VCC, the scanning circuit 110 provides high level voltage signals to all the scanning lines 141 simultaneously, such that all the TFTs 143 are switched on, and the liquid crystal capacitors 147 are discharged. After the discharging process, the electric field in each pixel unit 148 is removed, and the image displayed by the LCD 10 disappears.

However, the external command may not last for a sufficiently long period of time. If the external command lapses within the discharging process, the control unit 131 is liable to stop providing the low level voltage signal to the first transistor 132. In this circumstance, the power voltage signal VCC cannot output to the scanning circuit 110, and accordingly the high level voltage signals outputted by the scanning circuit 110 are canceled. Thus the discharging process stops ahead of time, and the liquid crystal capacitors 147 are incapable of discharging completely. Residual charges in the liquid crystal capacitors 147 may cause an unwanted residual image to be displayed on the LCD 10.

What is needed is to provide an LCD that can overcome the above-described deficiencies.

SUMMARY

In a first aspect, a liquid crystal display includes a liquid crystal panel having a plurality of pixel units, a scanning circuit configured to activate the pixel units, and a power supply circuit having a control unit and a logic converter. The control unit generates a control signal when an external command is applied to the power supply circuit. The logic converter carries out a predetermined logic calculation between the control signal and the external command. The scanning circuit activates all the pixel units to discharge in response to a result of the logic calculation, such that an image displayed by the liquid crystal panel is removed.

In a second aspect, a liquid crystal display includes a plurality of pixel units, a scanning circuit connected to the pixel units, and a power supply circuit comprising a control unit and a logic converter. When the liquid crystal display is switched off, an external command is provided to the power supply circuit. The power supply circuit generates a control signal via the control unit according to the external command, carries out a predetermined logic calculation between the external command and the control signal via the logic converter, so as to provide an output enable signal. The scanning circuit drives all the pixel units to discharge in response to the output enable signal.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
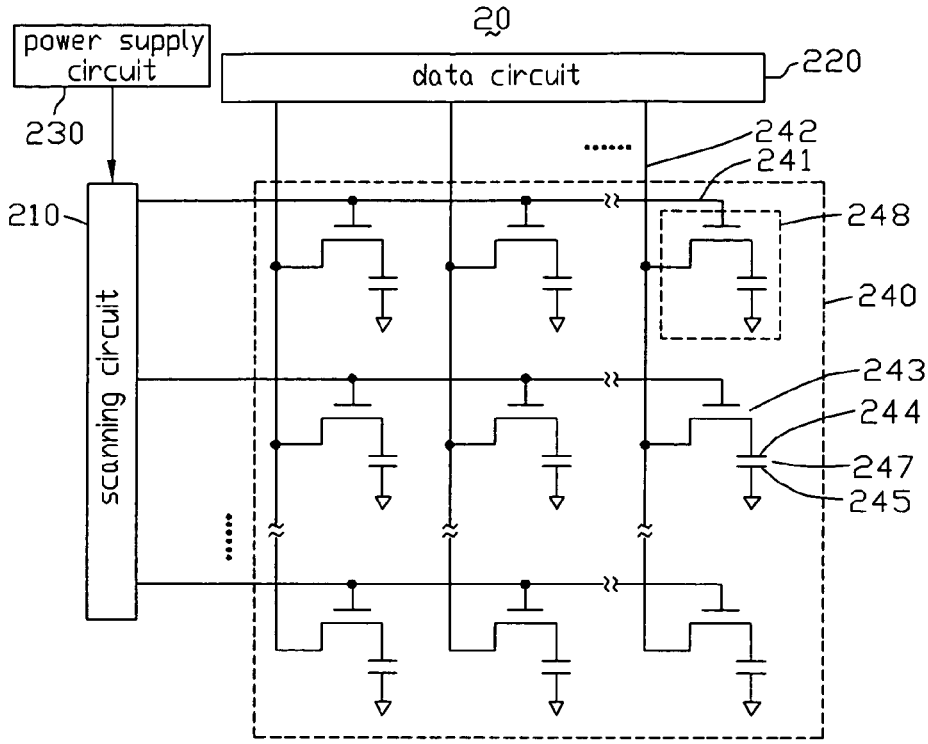
FIG. 1 is essentially an abbreviated circuit diagram of an LCD according to a first embodiment of the present invention, the LCD including a power supply circuit.

FIG. 1 is an abbreviated circuit diagram of an LCD according to a first embodiment of the present invention. The LCD 20 includes a scanning circuit 210, a data circuit 220, a power supply circuit 230, and a liquid crystal panel 240.

The liquid crystal panel 240 includes n rows of parallel scanning lines 241 (where n is a natural number), m columns of parallel data lines 242 perpendicular to the scanning lines 241 (where m is also a natural number), and a plurality of pixel units 248 cooperatively defined by the crossing scanning lines 241 and data lines 242. The pixel units 248 are arranged in a matrix. The scanning lines 241 are connected to the scanning circuit 210. The data lines 242 are connected to the data circuit 220.

Each pixel unit 248 includes a TFT 243, a pixel electrode 244, and a common electrode 245. A gate electrode of the TFT 243 is connected to a corresponding one of the scanning lines 241, and a source electrode of the TFT 243 is connected to a corresponding one of the data lines 242. Further, a drain electrode of the TFT 243 is connected to the pixel electrode 244. The common electrode 245 is generally opposite to the pixel electrode 244, with liquid crystal molecules (not shown) sandwiched therebetween, so as to cooperatively form a liquid crystal capacitor 247.

Figure 2:
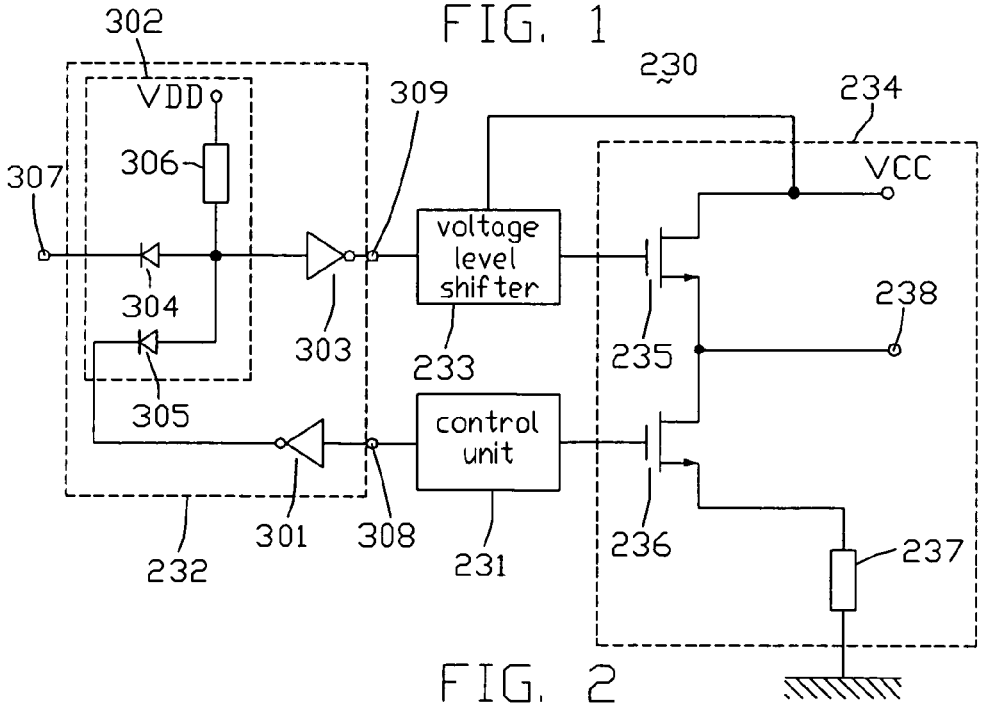
FIG. 2 is a diagram of the power supply circuit of the LCD of FIG. 1.

Referring also to FIG. 2, the power supply circuit 230 includes a control unit 231, a logic converter 232, a voltage level shifter 233, and an output control circuit 234.

The control unit 231 is configured to provide a control signal in response to an external command when the LCD 20 is switched off, and includes a first output terminal (not labeled) and a second output terminal (not labeled). The first and second output terminals are respectively used to output the control signal to the logic converter 232 and the output control circuit 234.

The logic converter 232 is configured to carry out a predetermined logic calculation, and includes a first input terminal 307 configured for receiving the external command, a second input terminal 308 configured for receiving the control signal from the control unit 231, and an output terminal 309 configured to output a result of the logic calculation to the voltage level shifter 233. Assuming that the control signal and the external command are respectively X and Y, the predetermined logic calculation can be expressed as $Z=\overline{X\cdot Y}$, where Z represents the calculation result.

In particular, the logic converter 232 includes a first logic NOT gate 301, a logic AND gate 302, and a second logic NOT gate 303. The logic AND gate 302 includes a first diode 304, a second diode 305, and a first resistor 306. A negative terminal of the first diode 304 serves as the first input terminal 307 of the logic converter 232. A positive terminal of the first diode 304 is configured to receive a logic power voltage VDD via the first resistor 306, and is connected to an input terminal of the second logic NOT gate 303 and a positive terminal of the second diode 305. A negative terminal of the second diode 305 is connected to an output terminal of the first logic NOT gate 301. An input terminal of the first logic NOT gate 301 serves as the second input terminal 308 of the logic converter 232, and an output terminal of the second logic NOT gate 303 serves as the output terminal 309 of the logic converter 232.

The voltage level shifter 233 is configured to adjust a voltage level of the calculation result outputted by the logic converter 232 according to an analog power voltage VCC, so as to generate an output enable (OE) signal.

The output control circuit 234 includes a first transistor 235, a second transistor 236, a second resistor 237, and an output terminal 238. The first and second transistors 235, 236 are both PMOS transistors. A gate electrode of the first transistor 235 is configured to receive the OE signal from the voltage level shifter 233. A drain electrode of the first transistor 235 is configured to receive the analog power voltage VCC. A source electrode of the first transistor 235 is connected to the output terminal 238 and to a drain electrode of the second transistor 236. A gate electrode of the second transistor 236 is configured to receive the control signal from the control unit 231. A source gate electrode of the second transistor 236 is grounded via the second resistor 237. The output terminal 238 is further connected to the scanning circuit 210.

In operation, the scanning circuit 210 provides a plurality of scanning signals to the scanning lines 241 sequentially, so as to activate the pixel units 248 row by row. The data circuit 220 provides a plurality of data voltage signals to the pixel electrodes 244 of the activated pixel units 248. Thereby, the liquid crystal capacitors 247 of the activated pixel units 248 are charged, and an electric field is generated between the pixel electrode 244 and the common electrode 245 in each pixel unit 248. The electric field drives the liquid crystal molecules to control light transmission of the pixel unit 248, such that the pixel unit 248 displays a particular color (e.g. red, green, or blue) having a corresponding gray level. The aggregation of colors displayed by all the pixel units 248 simultaneously constitutes an image viewed by a user of the LCD 20.

When the LCD 20 is switched off, an external command is provided to the control unit 231 and the logic shifter 232. The external command can for example be generated by a processor in response to a switch key being manually pressed by a user. Typically, the external command is a high level voltage signal. Due to the external command, the control unit 231 outputs a control signal having a high level voltage, and accordingly the second transistor 236 is switched off.

In addition, the control signal is converted to a low level voltage signal by the first logic NOT gate 301, and outputted to the logic AND gate 302. In the logic AND gate 302, the first diode 304 is switched off due to the high level external command, and the second diode 305 is switched on due to the low level voltage signal. The low level voltage signal is transmitted to the second logic NOT gate 303 via the second diode 305, converted to a high level voltage signal again by the second logic NOT gate 303, and outputted to the voltage level shifter 233 via the output terminal 309.

The voltage level shifter 233 adjusts the voltage level of the high level voltage signal outputted by the logic converter 232, so as to provide an output enable (OE) signal having a negative polarity and a value substantially the same as the analog power voltage VCC. Such OE signal causes the first transistor 235 to be in a deep saturation state. Thereby, the analog power voltage VCC is outputted to the scanning circuit 210 via the first transistor 235 and the output terminal 238.

The analog power voltage VCC further enables the scanning circuit 210 to provide high level voltage signals to all the scanning lines 241 simultaneously, such that all the TFTs 243 are switched on, and the liquid crystal capacitors 247 are discharged.

Before the liquid crystal capacitors 247 discharge completely, the external command may disappear. This may for example happen when the switch key is prematurely or improperly released by the user. In this situation, the control signal drops to a low level voltage, such that the second diode 305 is switched off. Simultaneously, an electrical potential of the first input terminal 307 of the logic converter 232 also drops to a low level voltage. Thereby, the first diode 304 is switched on, and the logic converter 232 continues to output the high level voltage signal to the voltage level shifter 233. That is, although the external command lapses or disappears ahead of time, the high level voltage signal received by the voltage level shifter 233 is maintained. Thus the voltage level shifter 233 continues to provide the OE signal to the output control circuit 234, and accordingly the analog power voltage VCC continues outputting to the scanning circuit 210 until the discharging process is completed. The electric field between the pixel electrode 244 and the common electrode 245 in each pixel unit 248 is thereby completed removed, and the image displayed on the liquid crystal panel 240 of the LCD 20 disappears.

In the LCD 20, the logic converter 232 and the voltage level shifter 233 are employed to cooperatively provide the OE signal. Due to the logic calculation carried out in the logic converter 232, when the external command is provided to control the LCD 20 to be switched off, the OE signal is provided to the output control circuit 234 stably, even if the external command lapses or ceases unusually early or quickly. Thus the liquid crystal capacitors 247 are capable of discharging completely, and any unwanted residual image that might otherwise be displayed on the liquid crystal panel 240 is not displayed.

Moreover, the voltage level adjustment of the voltage level shifter 233 causes the OE signal to have a value the same as the analog power voltage VCC. This further drives the first transistor 235 to be in a deep saturation state, and accordingly the analog power voltage VCC can be outputted to the scanning circuit 210 without being consumed by the first transistor 235. By employing such analog power voltage VCC, all the TFTs 243 of the pixel units 248 are switched on completely, and the discharging process of the liquid crystal capacitors 247 is more reliable.

Figure 3:
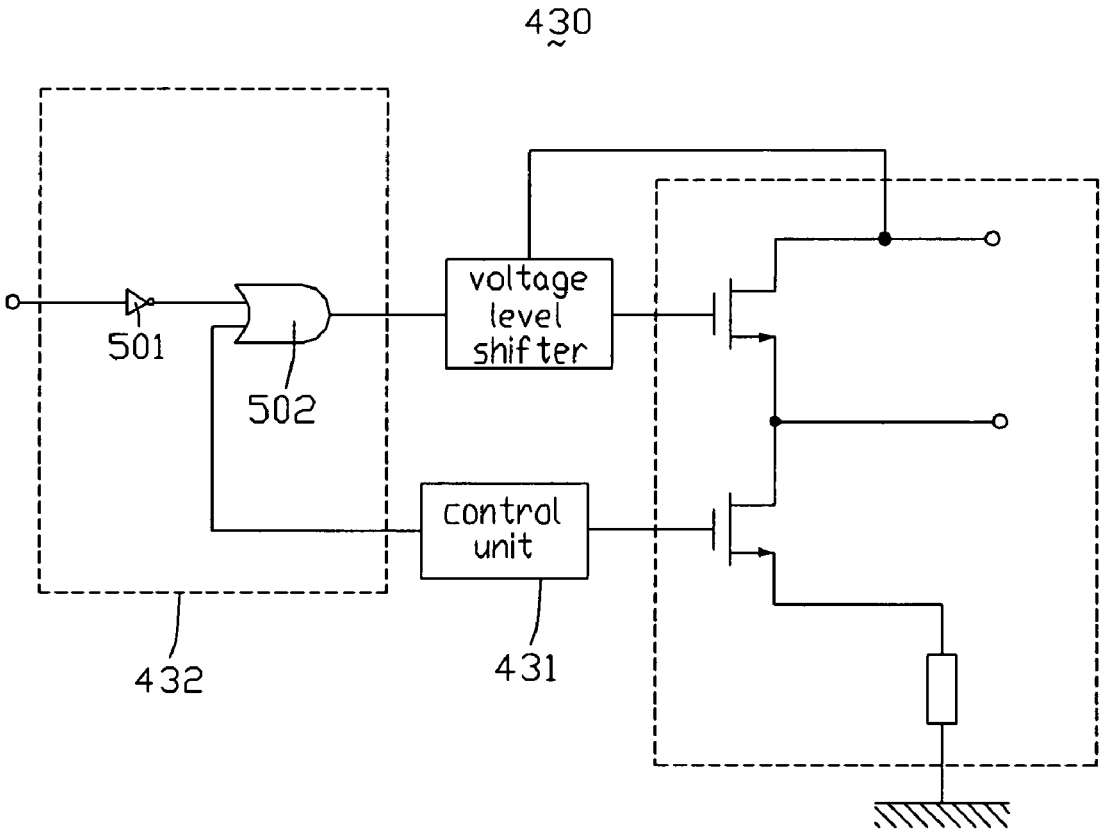
FIG. 3 is a diagram of a power supply circuit of an LCD according to a second embodiment of the present invention.
Figure 4:
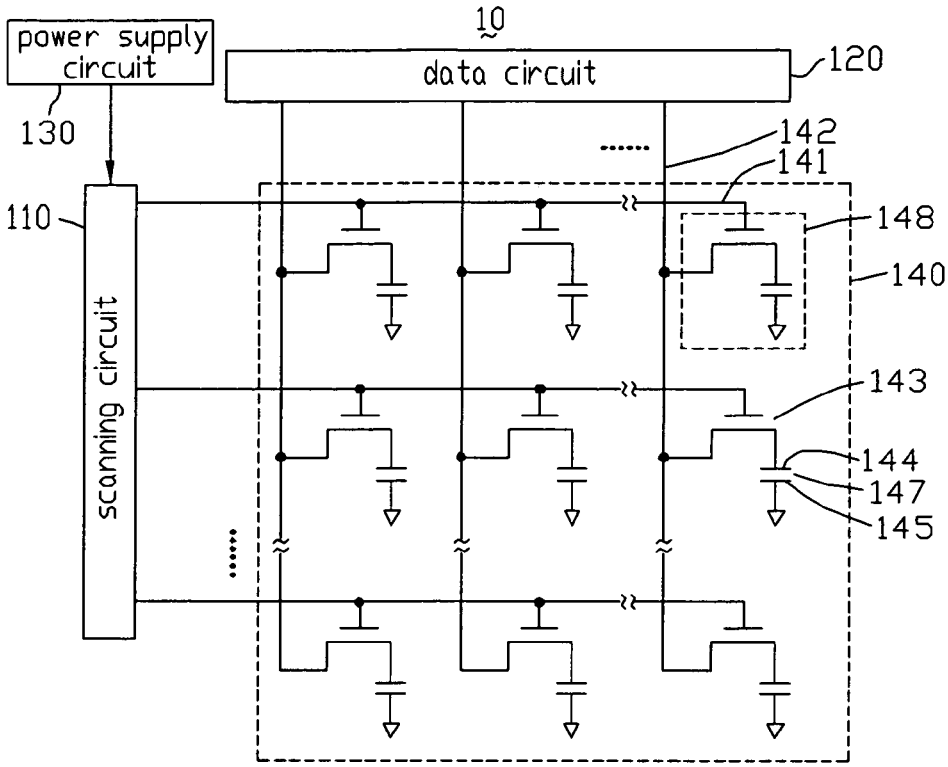
FIG. 4 (RELATED ART)
FIG. 4 is essentially an abbreviated circuit diagram of a conventional LCD, the LCD including a power supply circuit.
Figure 5:
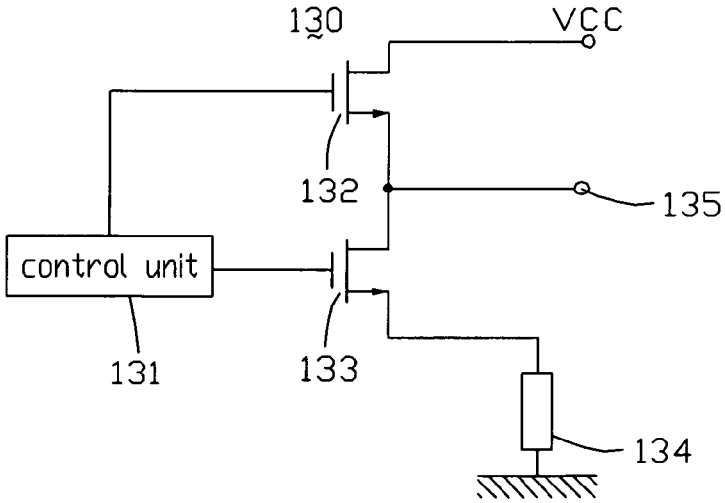
FIG. 5 (RELATED ART)
FIG. 5 is a diagram of the power supply circuit of the LCD of FIG. 4.

FIG. 3 is a circuit diagram of a power supply circuit 430 of an LCD according to a second embodiment of the present invention. The power supply circuit 430 is similar to the power supply circuit 230. However, the power supply circuit 430 includes a control unit 431 configured to provide a control signal, and a logic converter 432 having a logic NOT gate 501 and a logic OR gate 502. When the LCD of the second embodiment is switched off, an external command is outputted to the logic OR gate 501 via the logic NOT gate 502, and the control signal is outputted to the logic OR gate 501 directly. Thereby, the logic converter 432 is capable of carrying out a logic calculation, namely $Z=X+\overline{Y}$, where X is the control signal and Y is the external command. It is noted that the logic calculation $Z=X+\overline{Y}$ has a logic function substantially the same as the logic function $Z=\overline{X\cdot Y}$ carried out by the logic converter 232 of the power supply circuit 230. Therefore by employing the power supply circuit 430, the LCD of the second embodiment can also eliminate any unwanted residual image that might otherwise be displayed.

It is to be further understood that even though numerous characteristics and advantages of preferred and exemplary embodiments have been set out in the foregoing description, together with details of structures and functions associated with the embodiments, the disclosure is illustrative only; and that changes may be made in detail (including in matters of arrangement of parts) within the principles of the invention to the full extent indicated by the broad general meaning of the terms in which the appended claims are expressed.

What is claimed is:

1. A liquid crystal display, comprising:

a liquid crystal panel comprising a plurality of pixel units;

a scanning circuit configured to activate the pixel units;

a power supply circuit comprising:

a control unit configured to generate a control signal in response to an external command when the liquid crystal display is switched off;

a logic converter comprising a logic AND gate, a first logic NOT gate, and a second logic NOT gate, the logic AND gate comprising a first input terminal configured to receive the external command directly, a second input terminal configured to receive the corresponding control signal via the first logic NOT gate, an output terminal configured to output a first logic calculation result according to the external command and the corresponding control signal, and provide the first logic calculation result to the second logic NOT gate, the second logic NOT gate configured to receive the first logic calculation result, and convert the first logic calculation result into a second logic calculation result;

a voltage level shifter directly connected to the second logic NOT gate for receiving the second logic calculation result, and the voltage level shifter configured to adjust a voltage level of the second logic calculation result to generate an output enable signal; and an output control circuit comprising a first transistor, a second transistor, a first resistor, and an output terminal, the first transistor comprising a gate electrode configured to receive the output enable signal from the voltage level shifter, a drain electrode configured to receive an analog power voltage, and a source electrode connected to the output terminal, the second transistor comprising a gate electrode configure to receive the corresponding control signal from the control unit, a drain electrode connected to the drain electrode of the first transistor and the output terminal, and a source electrode connected to ground via the first resistor, and the output control circuit configured to output the analog power voltage to the scanning circuit according to both the control signal and the output enable signal;

wherein the scanning circuit drives all the pixel units to discharge in response to the analog power voltage such that an image displayed by the liquid crystal panel is removed.

2. The liquid crystal display of claim 1, wherein the logic AND gate comprises a first diode, a second diode, and a second resistor, a negative terminal of the first diode is configured to receive the external command, a positive terminal of the first diode is configured to receive a digital power voltage via the second resistor, and is connected to the second logic NOT gate and a positive terminal of the second diode, a negative terminal of the second diode is connected to the first logic NOT gate.

3. The liquid crystal display of claim 1, wherein a value of the output enable signal is substantially the same as the analog power voltage.

4. The liquid crystal display of claim 1, wherein the first transistor and the second transistor are both P-channel metal oxide semiconductor transistors.

5. The liquid crystal display of claim 1, wherein the scanning circuit outputs a plurality of high level voltage signals to the pixel units in response to the analog power voltage, so as to drive the pixel units to discharge.

6. The liquid crystal display of claim 1, wherein the external command is provided by a processor, and is generated in response to a switch key being manually pressed by a user.

7. A liquid crystal display, comprising:

a plurality of pixel units;

a scanning circuit connected to the pixel units;

a power supply circuit comprising:

a control unit configured to generate a control signal in response to an external command when the liquid crystal display is switched off;

a logic converter comprising a logic NOT gate, and a logic OR gate, the logic OR gate configured to receive the external command via the logic NOT gate and the control signal from the control unit, and generate a logic calculation result according to the external command and the control signal;

a voltage level shifter directly connected to the logic OR gate for receiving the logic calculation result, and voltage level shifter configured to adjust a voltage level of the logic calculation result to generate an output enable signal; and an output control circuit comprising a first transistor, a second transistor, a first resistor, and an output terminal, the first transistor comprising a gate electrode configured to receive the output enable signal from the voltage level shifter, a drain electrode configured to receive an analog power voltage, and a source electrode connected to the output terminal, the second transistor comprising a gate electrode configure to receive the corresponding control signal from the control unit, a drain electrode connected to the drain electrode of the first transistor and the output terminal, and a source electrode connected to ground via the first resistor, and the output control circuit configured to output the analog power voltage to the scanning circuit according to both the control signal and the output enable signal;

wherein the scanning circuit drives all the pixel units to discharge in response to the analog power voltage such that an image displayed by the liquid crystal panel is removed.

8. The liquid crystal display of claim 7, wherein the voltage level shifter adjusts a value of the output enable signal to be substantially the same as the analog power voltage.

9. The liquid crystal display of claim 7, wherein the first transistor and the second transistor are both P-channel metal oxide semiconductor transistors.

10. The liquid crystal display of claim 7, wherein the external command is provided by a processor, and is generated in response to a switch key being manually pressed by a user.

* * * * *

UNITED STATES PATENT AND TRADEMARK OFFICE

CERTIFICATE OF CORRECTION

PATENT NO. : 8,188,962 B2
APPLICATION NO. : 12/157016
DATED : May 29, 2012
INVENTOR(S) : Wei Guo et al.

It is certified that error appears in the above-identified patent and that said Letters Patent is hereby corrected as shown below:

Title Page

Item (73) section, please change "Innolux Display Corp." to --Chimei Innolux Corporation--.

Signed and Sealed this
Sixteenth Day of April, 2013

Teresa Stanek Rea
*Acting Director of the United States Patent and Trademark Office*